US009706801B2

(12) United States Patent
Hunkele

(10) Patent No.: US 9,706,801 B2
(45) Date of Patent: Jul. 18, 2017

(54) MULTI-PURPOSE TRAVEL GARMENT

(71) Applicant: Peter Gerard Hunkele, Ashland, OR (US)

(72) Inventor: Peter Gerard Hunkele, Ashland, OR (US)

(73) Assignee: LEFTE, LLC, Ashland, OR (US)

( * ) Notice: Subject to any disclaimer, the term of this patent is extended or adjusted under 35 U.S.C. 154(b) by 355 days.

(21) Appl. No.: 14/623,611

(22) Filed: Feb. 17, 2015

(65) Prior Publication Data

US 2015/0250240 A1 Sep. 10, 2015

Related U.S. Application Data

(60) Provisional application No. 61/948,070, filed on Mar. 5, 2014.

(51) Int. Cl.

| | |
|---|---|
| ***A41D 3/08*** | (2006.01) |
| ***A41D 15/04*** | (2006.01) |
| ***A41D 3/04*** | (2006.01) |

(52) U.S. Cl.

CPC ..... *A41D 15/04* (2013.01); *A41D 3/04* (2013.01); *A41D 2200/20* (2013.01)

(58) Field of Classification Search

CPC ..... A41D 3/06; A41D 3/08; A41D 2200/20
USPC ..... 2/86, 88, 84, 468
See application file for complete search history.

(56) References Cited

U.S. PATENT DOCUMENTS

| | | | | |
|---|---|---|---|---|
| 2,670,470 | A | 5/1951 | Manheim et al. | |
| 2,682,056 | A * | 6/1954 | Werber | A41D 3/00 2/84 |
| 4,158,892 | A | 6/1979 | Gonzales | |
| 4,285,081 | A * | 8/1981 | Price | A47C 7/383 297/391 |
| 4,602,385 | A | 7/1986 | Warren | |
| 5,913,448 | A | 6/1999 | Mann et al. | |
| 6,151,735 | A * | 11/2000 | Koby | A47G 9/1027 5/644 |
| 6,643,870 | B2 | 11/2003 | Bertrand | |
| 6,647,573 | B2 | 11/2003 | Corbin | |
| 6,665,878 | B1 * | 12/2003 | Way | A41D 3/02 2/84 |
| 6,922,860 | B2 * | 8/2005 | Cuddy | A47C 20/026 5/632 |
| 8,424,113 | B2 | 4/2013 | Sprole | |
| 8,650,664 | B2 | 2/2014 | Parr | |

(Continued)

*Primary Examiner* — Tejash Patel
(74) *Attorney, Agent, or Firm* — Jerry Haynes Law

(57) ABSTRACT

A multi-purpose travel garment facilitates upright sleep and access to travel and sleep related items during travel. The garment is a poncho and is fabricated in a material composition that is warm and spacy. The garment includes body and neck cavities that retain neck and torso supports for optimal support of the torso and head while sleeping in an upright position. The garment also provides pouches that are easily accessible and contain travel related items. The garment also includes a head portion that cushions and supports the head, while also selectively covering the eyes to block light during sleep. A body and head adjustment mechanism, such as a drawstring, adjusts the size of the garment. A container compacts to stow in the pouches and expands for functionality. A pump generates a fluid for filling the supports. A channel carries and conceals circuitry form an external electronic device.

20 Claims, 6 Drawing Sheets

(56) References Cited

U.S. PATENT DOCUMENTS

| | | | | |
|---|---|---|---|---|
| 8,726,421 | B2 | 5/2014 | Alvarez | |
| 2009/0235426 | A1 | 9/2009 | Johnston et al. | |
| 2009/0260711 | A1 | 10/2009 | Alder et al. | |
| 2010/0031413 | A1 | 2/2010 | Jensen | |
| 2010/0170024 | A1 | 7/2010 | Seter | |
| 2010/0229275 | A1 | 9/2010 | Wilson | |
| 2012/0144550 | A1 | 6/2012 | Nejad | |
| 2012/0255099 | A1 | 10/2012 | Sternberg | |
| 2013/0125312 | A1 | 5/2013 | Harooni | |
| 2013/0152270 | A1 | 6/2013 | Neal et al. | |
| 2013/0239290 | A1 | 9/2013 | Rossi | |
| 2015/0026863 | A1* | 1/2015 | Elsmo | A47G 9/066 2/84 |
| 2016/0345652 | A1* | 12/2016 | Harty | A61B 5/01 |

* cited by examiner

MULTI-PURPOSE TRAVEL GARMENT

CROSS-REFERENCE TO RELATED APPLICATIONS

This application claims the benefit of U.S. provisional application No. 61/948,070, filed Mar. 5, 2014 and entitled TRAVEL SLEEPING GARMENT, which provisional application is incorporated by reference herein in its entirety.

FIELD OF THE INVENTION

Exemplary embodiments of the disclosure relate generally to a multi-purpose travel garment that facilitates sleep and access to sleep related items during travel. More particularly, exemplary embodiments of the disclosure relate to a multi-purpose travel garment that facilitates upright sleep and access to travel and sleep related items during travel by providing cavities that retain neck and torso supports for optimal support during sleep in an upright position, providing pouches that are easily accessible and retain the sleep and travel related items, providing a head portion that cushions and supports the head, while also selectively covering the eyes to block light during sleep, and forming a poncho configuration and a material composition that is warm and spacey for ease of movement.

The multi-purpose travel garment facilitates sleep during travel by providing sufficient storage capacity for organizing and retaining sleep related items, including neck, head, and torso supports. The travel garment creates a more conducive sleeping environment for a traveler by minimizing many of the obstacles encountered while attempting to sleep during travel.

BACKGROUND OF THE INVENTION

An example of a garment that assists in sleeping is described in U.S. Patent Publication No. 2012/0255,099 to Sternberg, which is incorporated by reference here in its entirety. As discussed in Sternberg, an outerwear garment, composed of a body having a neckline and a collar includes a collar accessory includes front and back regions of material joined to the body of the outerwear garment in proximity to the neckline.

Sternberg also teaches that the collar accessory has an interior space of changeable volume between the front and back regions. An elongated inflatable air cushion is positioned within the interior space. The air cushion expands into the interior space and assumes a tubular shape to support at least one of the neck and head of the wearer when the air cushion is in an inflated state. Thus, Sternberg teaches a head and neck support that is integrated into an outer garment.

This may be effective while sleeping in an upright position. The supports are, however, often difficult to carry and may not provide support to the head, neck, torso, and back simultaneously. Also, travel and sleep related items may be difficult to access while resting on the inflatable supports described in Sternberg.

In many instances, traveling by plane, train, bus, or automobile often occurs in a substantially upright position. Sitting in the upright position can become quite uncomfortable when wishing to rest or sleep, particularly when the motion of the vehicle is turbulent. Additionally, accessing sleep or travel related items can be problematic while resting. Undesirable lighting and sound may also impair proper sleeping.

Often, an inflatable torso, neck, and head supports can be placed on the seat during travel to help support the neck, head, back, and lumbar region. These various supports enhance the comfort of the traveler when trying to rest or sleep. Unfortunately, the supports are easily prone to become dislodged through movement by the traveler or the vehicle. Another problem a traveler may encounter while attempting to sleep during travel is the inability to control light and noise levels, especially while traveling in a public transportation vehicle.

Additionally, travel and sleep related items commonly utilized by the traveler may be difficult to access, as the items are often stored in luggage, or placed underneath the seat. The present invention helps facilitate sleep and access to the travel and sleep related items during traveling by addressing the aforementioned problems.

SUMMARY OF THE INVENTION

Exemplary embodiments of the disclosure are generally directed to a multi-purpose travel garment. An illustrative embodiment of the multi-purpose travel garment includes a body portion configured to cover a torso, back, and shoulder area. The body portion is defined by at least one body cavity and at least one body pouch. The body cavity is configured to retain at least one body support that facilitates sleeping in an upright position by supporting a back and torso area. The body pouch is configured to retain and provide facilitated access to a plurality of items that may be useful for sleeping and traveling.

The garment further includes an extremity portion configured to cover the arms. The extremity portion is defined by at least one extremity pouch. The extremity pouch is configured to contain the plurality of items, as described for the body pouch. The garment further includes a head portion configured to cover the head. The head portion includes a neck cavity. The neck cavity is configured to retain at least one neck support that facilitates sleeping in an upright position by supporting a neck and head. The head portion further includes a visor that is configured to at least partially block light from the eyes. The head portion further includes at least one head cushion that contours the surface of the head portion and forms a cushioned support for the head. A container compacts into the body or extremity pouches for stowage, and expands outside of the pouches to store the items or foods and drinks.

Exemplary embodiments of the disclosure are further generally directed to a method of facilitating sleep with a travel garment. An illustrative embodiment of the method includes providing a body portion defined by at least one body cavity and at least one body pouch; positioning at least one body support in the body cavity, wherein the body support is configured to facilitate upright sleeping; positioning a plurality of items in the body pouch, wherein the body pouch is configured to facilitate access to the items from a sleeping position; providing an extremity portion defined by at least one extremity pouch; positioning the plurality of items in the extremity pouch, wherein the extremity pouch is configured to facilitate access to the items from a sleeping position; providing a head portion defined by a neck cavity, a visor, and at least one head cushion; positioning a neck support in the neck cavity, wherein the neck support is configured to facilitate upright sleeping; selectively restricting light with the visor; and forming a cushioned support for the head with the head cushion.

BRIEF DESCRIPTION OF THE DRAWINGS

Exemplary embodiments of the present disclosure will hereinafter be described in conjunction with the following drawing figures, wherein like numerals denote like elements, and wherein.

DETAILED DESCRIPTION

Figure 1:
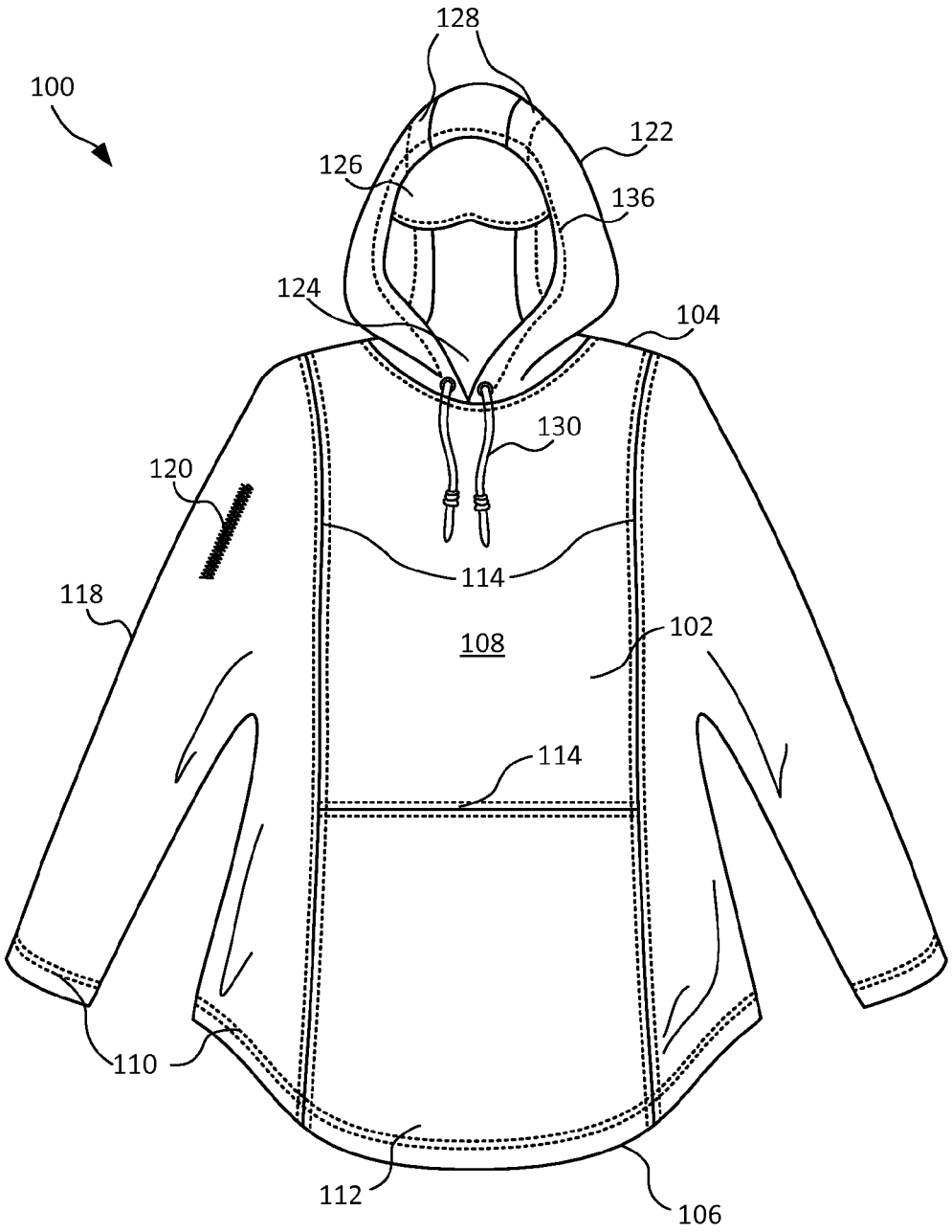
FIG. 1 is a perspective view of an illustrative embodiment of the front side of the multi-purpose travel garment with at least one cavity and at least one pouch.

Various exemplary embodiments of the present disclosure are described below. Use of the term "exemplary" or "illustrative" means illustrative or by way of example only, and any reference herein to "the invention" is not intended to restrict or limit the invention to exact features or steps of any one or more of the exemplary embodiments disclosed in the present specification. References to "exemplary embodiment," "one embodiment," "an embodiment," "various embodiments," and the like, may indicate that the embodiment(s) of the invention so described may include a particular feature, structure, or characteristic, but not every embodiment necessarily includes the particular feature, structure, or characteristic. Further, repeated use of the phrase "in one embodiment," or "in an exemplary embodiment," do not necessarily refer to the same embodiment, although they may.

Terms such as "preferably", "commonly", and "typically" are not utilized herein to limit the scope of the invention or to imply that certain features are critical, essential, or even important to the structure or function of the invention. Rather, these terms are merely intended to highlight alternative or additional features that may or may not be utilized in a particular embodiment of the present invention.

Exemplary embodiments of the present disclosure are described more fully hereinafter with reference to the accompanying drawings. Like numbers used herein refer to like elements throughout. Embodiments of the disclosure may be embodied in many different forms and should not be construed as limited to the particular embodiments set forth herein; rather, these embodiments are provided so that the disclosure will be operative, enabling, and complete. Accordingly, the particular embodiments disclosed herein are meant to be illustrative only and not limiting as to the scope of the invention. Moreover, many embodiments, such as adaptations, variations, modifications, and equivalent arrangements, will be implicitly disclosed by the embodiments described herein and fall within the scope of the present disclosure.

Although specific terms are employed herein, they are used in a generic and descriptive sense only and not for purposes of limitation. Unless otherwise expressly defined herein, such terms are intended to be given their broad ordinary and customary meaning not inconsistent with that applicable in the relevant industry and without restriction to any specific embodiment hereinafter described. As used herein, the article "a" is intended to include one or more items. Where only one item is intended, the term "one", "single", or similar language is used. When used herein to join a list of items, the term "or" denotes at least one of the items, but does not exclude a plurality of items of the list.

For exemplary methods or processes of the invention, the sequence and/or arrangement of steps described herein are illustrative and not restrictive. Accordingly, it should be understood that, although steps of various processes or methods may be shown and described as being in a sequence or temporal arrangement, the steps of any such processes or methods are not limited to being carried out in any particular sequence or arrangement, absent an indication otherwise. Indeed, the steps in such processes or methods generally may be carried out in various different sequences and arrangements while still falling within the scope of the present invention.

Additionally, any references to advantages, benefits, unexpected results, or operability of the present invention are not intended as an affirmation that the invention has been previously reduced to practice or that any testing has been performed. Likewise, unless stated otherwise, use of verbs in the past tense (present perfect or preterit) is not intended to indicate or imply that the invention has been previously reduced to practice or that any testing has been performed.

Referring initially to FIGS. 1-5B of the drawings, an illustrative embodiment of the multi-purpose travel garment 100, hereinafter garment 100, is generally indicated by reference numeral 100. A multi-purpose travel garment 100 is efficacious for facilitating sleep in an upright position and enabling access to sleep and travel related items during travel by providing: cavities that retain neck and torso supports; pouches that are easily accessible and retain the sleep and travel related items; a head portion 122 that cushions the head and supports the head and neck, while also selectively covering the eyes to block light during sleep. The garment 100 is defined by a poncho configuration and a material composition that is warm and spacious to enable easy movement during sleep. The garment 100 stows a container 138 that compacts in the pouches for stowage and expands for functionality.

In some embodiments, the travel sleeping garment 100 may include, without limitation, a poncho, a serape, an Aguayo, a cape, a cloak, a belted plaid, a Rebozo, a Baja jacket, a jacket, a shirt, a hoodie, a gown, a pajama, sweatshirt, or any combination thereof. The garment 100 is sized and dimensioned to provide comfort during sleep and travel. The garment 100 is also fabricated from a porous material to enable breathability through the travel garment 100. The garment 100 may be fabricated from various materials that provide comfort during sleep, including, without limitation, cotton, mink fabric, fur fabric, wool, and synthetic blends. In some embodiments, the garment 100 may include a thick material for providing warmth.

Those skilled in the art will recognize that because the traveler may not have the capacity to control the temperature while traveling, the warmth generated by the garment 100 may help enhance sleep. Additionally, the travel garment 100 may be fabricated from a soft material and have loose ends to enhance comfort and enable unrestricted movement while sleeping. These features create a synergy for facilitating sleeping while in a state of travel.

Figure 2:
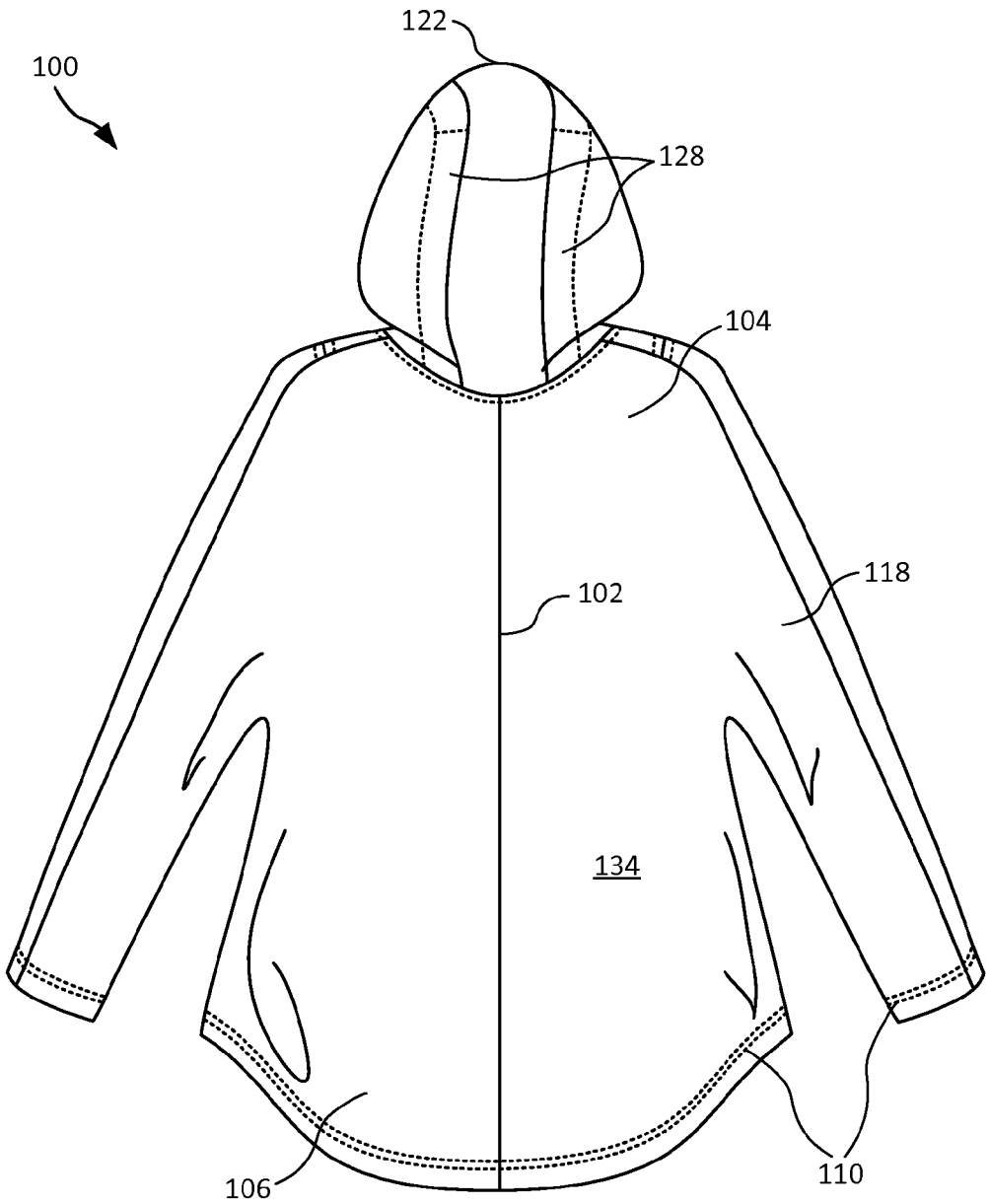
FIG. 2 is a perspective view of an illustrative embodiment of the back side of the multi-purpose travel garment.

As referenced in FIG. 1, the garment 100 may include a body portion 102 configured to at least partially cover the torso, shoulders, abdomen, and back of the traveler. The body portion 102 is defined by a front side 108 and a back side 134. The front side 108 is generally oriented in a forward direction, covering the chest and pelvic area. The back side 134, as shown in FIG. 2, is generally oriented in a rearward direction, covering the back and buttocks.

The body portion 102 further comprises an upper end 104 that encompasses the shoulder and chest area. The body portion 102 may further include a lower end 106 that encompasses the lower torso and waist. The lower end 106 may have a clean, hemmed edge, such as a hem 110. In one example, the lower end 106 forms a 1" hem with a 2-NDL cover stitch. In some embodiments, both the upper and lower ends 104, 106 may have at least one pleat 132 that enables expansion of the body portion 102. The at least one pleat 132 may run along the length of the body portion 102. In one embodiment, the pleat 132 comprises a series of parallel, spaced-apart 1½" pleats.

Looking at FIG. 1, the body portion 102 forms a substantial part of the garment 100, and can be size adjusted by the traveler, as desired for comfort during sleeping. A body adjustment mechanism (not shown) on the lower end 106 of the body portion 102 can be used to adjust the size of the body portion 102. In one embodiment, the body adjustment mechanism may include a drawstring and a drawstring lock.

In one embodiment, a body drawstring channel (not shown) is disposed along a perimeter of the lower end 106 of the body portion 102. The drawstring passes through the body drawstring channel, encompassing the lower end 106 of the body portion 102. The drawstring may include a pair of free ends. The drawstring lock may include an opening configured to frictionally engage the drawstring. The drawstring lock includes an opening for the free ends of the drawstring to pass through. The free ends of the drawstring can be pulled through the opening to draw in the lower end 106 around the lower torso or waist.

Conversely, the body portion 102 can be expanded by applying an outward force on the body drawstring channel. This force pulls the free ends of the drawstring into the drawstring lock; thereby increasing the diameter of the lower end 106 of the body portion 102. In other embodiments, the body adjustment mechanisms may, however, include, without limitation, expanding seams, hook and loop fasteners, buttons, zippers, and removable segments of the body portion 102.

Figure 3:
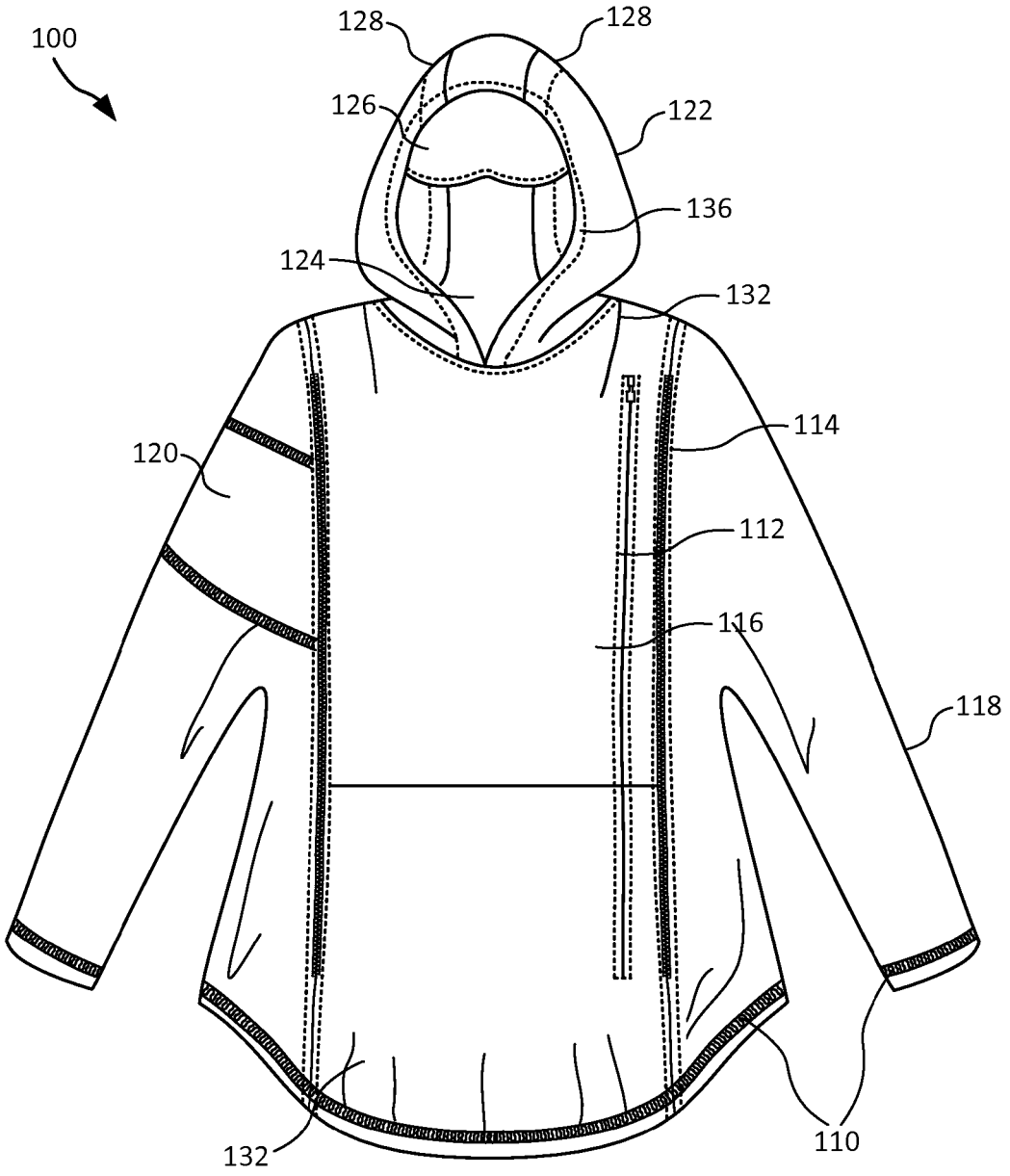
FIG. 3 is a perspective view of an illustrative embodiment of the front side of the multi-purpose travel garment with a body cavity fastener oriented vertically along the length of the body portion.

In some embodiments, the body portion 102 may be defined by at least one body cavity 112. The body cavity 112 may be oriented along the length of the body portion 102, as shown in FIG. 1, or transversely across the body portion 102, as shown in FIG. 3. The body cavity 112 is sized and dimensioned to retain at least one body support (not shown). The body support may include, without limitation, a sky rest pillow, an inflatable pillow, a fabric pillow, and a cushion. The body support helps provide a supportive, yet flexible cushion for the torso, back, and stomach areas. In some embodiments, the body support remains encased inside the body cavity 112 while providing the support for the torso, back, and stomach areas.

Those skilled in the art will recognize that this type of body support is especially useful while attempting to sleep in a substantially upright position, such as in a seat. In one embodiment, the body cavity 112 is sized and dimensioned to enable the body support to position transversely across the garment 100. In other embodiments, the body cavity 112 may, however, be arranged along the back of the traveler, orienting in any number of orientations and angles to form a desirable cushion for the back.

Turning back to FIG. 1, a body cavity fastener 114 may regulate access to the body cavity 112. The body cavity fastener 114 is configured to move between an open position and a closed position to insert, remove, or realign the body support from the body cavity 112. In this manner, the body support may be removed from the body cavity 112 for cleaning, realignment, replacement, or use of the garment 100 without the body support. The body cavity fastener 114 may include, without limitation, a zipper, a button, a magnet, and a hook and loop fastener. In one possible embodiment, the body fastener is a #3 nylon coiled zipper. It is significant to note that the at least one body cavity 112 can be disposed anywhere and in any orientation on the body portion 102 of the garment 100.

In some embodiments, the body cavity fastener 114 may have a dual function of enabling a seat belt to pass through the body portion 102 in conjunction with the body support. For example, without limitation, a pair of zippers on the body portion 102 enable a body support and the seat belt to pass through. The body support may then overlay the seat belt. The pair of zippers can then be fastened to a closed position to form a snug fit over both the body support and the seat belt.

In one embodiment, the body portion 102 may include a pump (not shown) for generating a fluid to fill the body support. The fluid is generated in the pump, and then flows into the body support. The pump may be integrated into the body portion 102 and operate to generate air or liquid to the body support. The pump may be battery operated, or manual. In yet another embodiment, the body support is inflated with the fluid through an integrated garment tube having a pinch valve mouthpiece. In this embodiment, the fluid is blown into the body support. The fluid may include, without limitation, air, water, and a gel.

The body portion 102 may further include at least one body pouch 116 configured to store a plurality of items (not shown). The plurality of items may be useful for facilitating sleep and travel. The items may be stored in the body pouch 116 in an organized manner, such that the traveler can easily access each item while inclined during sleep or while in a casual position. The plurality of items may include, without limitation, a travel document, an identification card, a communication device, a radio, MP3 player, a microprocessor, a key, toiletries, food, drinks, batteries, and therapeutic and medicinal drugs.

As referenced in FIGS. 1 and 3, a single body pouch 116 positions directly in front of the traveler, at the front side 108 of the body portion 102, for providing facilitated access to the items. For example, a frontally disposed body pouch 116 may form a passport holder. In other embodiments, a single body pouch 116 may be segregated into multiple compartments to help separate various items. For example, medicines and travel documents can be placed in different compartments of the same pouch. In other embodiments, the medicine and the travel document can, however, position in different body pouches 116 along the body portion 102.

Figure 4:
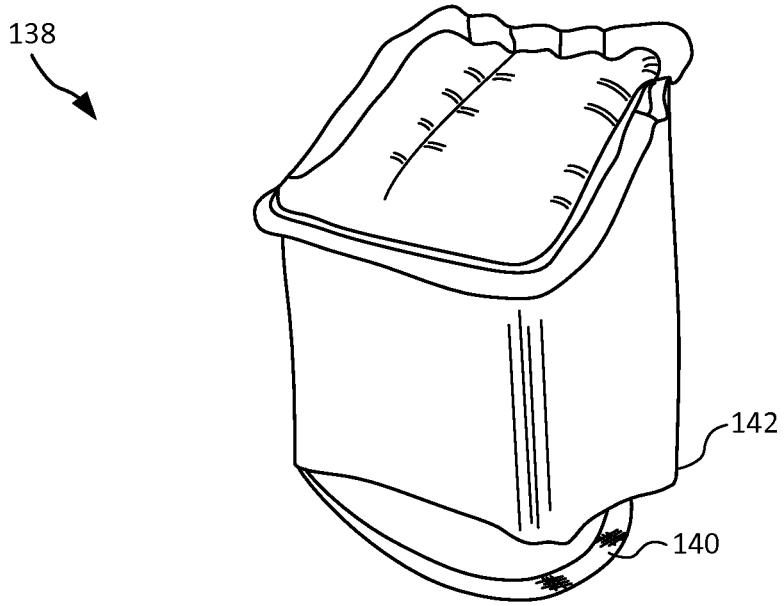
FIG. 4 is a perspective view of an illustrative embodiment of a container that compacts to stow in the pouch and expands for functionality.

Turning now to FIG. 4, the garment 100 may utilize internally stowed containing elements for storing the items. In one possible embodiment, a container 138 compacts into the body pouch 116 and expands outside of the body pouch 116 to store the items or foods and drinks. The container 138 may include a generally resilient material composition that easily compacts, rolls up, folds, or bends. In this manner, the container 138 may be stored and with minimal discomfort in the body pouch 116. The container 138 may include a generally cubicle shape. The container 138 may have a hard base 142 and generally resilient sidewalls and lid. A strap 140 may be used for carrying the container 138 and helping to compact the container 138 for stowage.

In some embodiments, a channel (not shown) extends from the body pouch 116 to an external area of the garment 100. The channel is configured to carry a wire circuitry for a headphone, a microphone, or other communication device outlet. The channel forms a protective cover for the circuitry to pass through. The channel also provides an aesthetic effect to the garment 100, since the circuitry is not visible while passing through the body portion 102. In this manner, a communication device, such as a radio; or a power source, such as a battery, may be stored in the body pouch 116, while the attached headphones or microphones may simultaneously be accessed from an external area of the garment 100. For example, the headphones may be placed in the ears.

In another example, ear buds for an MP3 player extend from the body pouch 116 and through the channel for providing soothing music to help the traveler sleep. In one alternative embodiment, an integrated communication device integrates into the body pouch 116 and channel. In this embodiment, the integrated communication device may be detached from the body pouch 116 for washing the garment 100.

FIG. 3 references an extremity portion 118 of the garment 100. The extremity portion 118 may include a pair of garment arms that extend from the body portion 102. The extremity portion 118 is sized and dimensioned to provide loose, comfortable protection to a pair of arms. Those skilled in the art will recognize that arms can bend and perform myriad movements. Sufficient spacing within the extremity portion 118 is necessary for comfort of the arms, especially during sleep in an often uncomfortable horizontal position.

The extremity portion 118 includes a pair of terminal ends, such as cuffs that terminate at a hem 110. The hem may have an aesthetic appearance. In one example, the hem 110 is a 1" hem 110 with a 2-NDL cover stitch. The pair of terminal ends of the extremity portion 118 is oversized to enable further space and comfort for the ends of the arms and the wrists. In one embodiment, the pair of terminal ends forms a loose sleeve with no cuffs or hem 110.

Similar to the body portion 102, the extremity portion 118 includes at least one extremity pouch 120 configured to store the plurality of travel or sleep related items on the pair of garment 100 arms. The at least one extremity pouch 120 can position anywhere along the extremity portion 118, such as along the forearm section of the garment arm. The extremity pouch 120 may be oriented along the length, or transversely across the extremity portion 118. The extremity pouch 120 is configured to contain the plurality of items, which may include, without limitation, a travel document, a headphone, an identification card, a communication device, a radio, a microprocessor, a key, toiletries, food, drinks, batteries, and therapeutic and medicinal drugs. In one alternative embodiment, the channel may extend from the extremity pouch 120, rather than the body pouch 116, to an external area of the garment 100.

Those skilled in the art, in light of the present teachings, will recognize that while both the body pouch 116 and the extremity pouch 120 can store the plurality of items, each pouch 116, 120 may be more effective for different types of items. For example, the extremity pouch 120 may bend and stretch more because of the position on the arm. Sensitive travel documents would, however, be better placed on the more stationary body pouch 116. In another example, medicine bottles can be lumpy, and could therefore be placed in a frontally disposed body pouch 116, rather than a rear-facing body pouch 116. It is significant to note that at least one body cavity 112 and the at least one body pouch 116 can be disposed anywhere and in any orientation on the extremity portion 118 of the travel garment 100.

As shown in FIG. 3, the garment 100 may include a head portion 122. The head portion 122 may include a hoodie or cap that pivotally attaches to a perimeter of the upper end 104 of the body portion 102. In some embodiments, the head portion 122 may, however, detachably join with the body portion 102. In one embodiment, the head portion 122 encapsulates the head and ears. The head portion 122 also includes components to at least partially cover the eyes. In this manner, the head is protected from hard surface, noises, and lighting; and thereby sleep is enhanced.

In one embodiment, the head portion 122 is defined by a neck cavity 124. The neck cavity 124 is disposed proximally to the junction between the head portion 122 and the upper end 104 of the body portion 102. The neck cavity 124 is configured to retain at least one neck support (not shown) that facilitates sleeping in the upright position. Similar to the body support, the neck support may be easily accessed from the neck cavity 124 for removal, insertion, realignment, and cleaning of the neck support.

The head portion 122 is size adjustable to conform to different head sizes and to enable secure fastening to the head, or easy removal from the head. In one embodiment, a head adjustment mechanism 130 is configured to adjust the fit of the head portion 122 on the head by drawing in the head portion 122 on the head, and loosening the head portion 122 from the head. The head adjustment mechanism 130 may include a head drawstring. The head adjustment mechanism 130 may, however, further include expanding seams, hook and loop fasteners, buttons, zippers, and removable segments of the head portion 122.

As illustrated in FIG. 1, the head drawstring passes through a head drawstring channel 136 that is aligned along a perimeter of the head portion 122. The head drawstring may include a pair of free ends. The head drawstring lock includes an opening for a pair of free ends of the head drawstring to pass through. The free ends of the head drawstring can be pulled through the opening to draw in the head portion 122 around the head. Conversely, the head portion 122 can be expanded by applying an outward force on the head drawstring channel 136 around the head portion 122. This force pulls the free ends of the head drawstring into the head drawstring lock to increase the diameter of the head portion 122.

The head portion 122 is further defined by a visor 126 that is configured to at least partially block light from the eyes. The visor 126 is configured to join with an opening in the head portion 122. The visor 126 is generally sized and dimensioned to cover the eyes. In this manner, light is restricted during sleep. The head portion 122 may include an outer or inner surface having at least one head cushion 128. The head cushion 128 provides additional comfort when the head engages a hard surface. The at least one head cushion 128 is disposed to contour an outer surface of the head portion 122; and thereby form a cushioned support for the head. In one embodiment, at least one head cushion 128 comprises a pair of 2½" pads that run along the length of the head portion 122. The head portion 122 serves to provide warmth and at least partially cover the ears, thereby restricting undesirable sound.

The head portion 122 includes a neck cavity 124 configured to receive a neck support. The neck cavity 124 is arranged along the neck area of the traveler. The neck support provides structural support to the neck and head area of the traveler. The neck support may include, without limitation, a neck pillow, an inflatable pillow, a fabric pillow, a U-shaped pillow, and a cushion. A neck cavity fastener, such as a zipper, button, or hook and loop fastener, regulates access to the neck cavity 124 for inserting and removing the neck support. In one embodiment, the same pump used to fill the body support with a fluid may be utilized for generating a fluid to fill the neck support. It is significant to note that the at least one neck cavity 124 can be disposed anywhere and in any orientation on the head portion 122.

In some embodiments, the head portion 122 includes a visor 126 configured to enable at least partial covering of the eyes. In this manner, the visor 126 is effective for at least partially blocking undesirable lighting. This light restricting capacity may be efficacious for promoting sleep and minimizing disturbances. The visor 126 may be fabricated from any solid or opaque material that forms a comfortable barrier between the eyes and the external lighting. The visor 126 pivotally attaches to the head portion 122. In some embodiments, the visor 126 may, however, detachably join with the head portion 122. In yet another embodiment, the visor 126 is sewn in a hoodie seam with double layer fabric interface and stitching.

According to one exemplary embodiment, the present disclosure may include the following advantages and objectives:

A. Travel garment 100 facilitates sleep in an upright position through multiple body and neck supports that are easily accessed from body and neck cavities;
B. Travel garment 100 provides a body cavity fastener 114 that regulates access to the at least one body cavity 112, such that the body and neck supports may be realigned, cleaned, replaced, and removed;
C. Travel garment 100 provides a head cushion 128 to form a cushion for the head region;
D. Travel garment 100 provides easy access to sleep and travel related items from a sleeping position through multiple body and arm pouches;
E. Travel garment 100 has a material composition that retains warmth in the body to enhance the sleeping environment;
F. Travel garment 100 is configured as a poncho for easy donning and removal;
G. Travel garment 100 provides drawstrings to secure that body portion 102 and head portion of the travel garment 100 around the torso and head;
H. Travel garment 100 provides a channel in the body portion 102 to conceal circuitry for connected electronic devices;
E. Travel garment 100 uses a visor 126 to selectively block light to the eyes;
F. Travel garment 100 is lightweight and can be easily carried;
G. Travel garment 100 material composition and poncho configuration materials are low cost;
H. Travel garment 100 is simple to use;
I. Travel garment 100 will work effectively in wet weather.

Figure 5A:
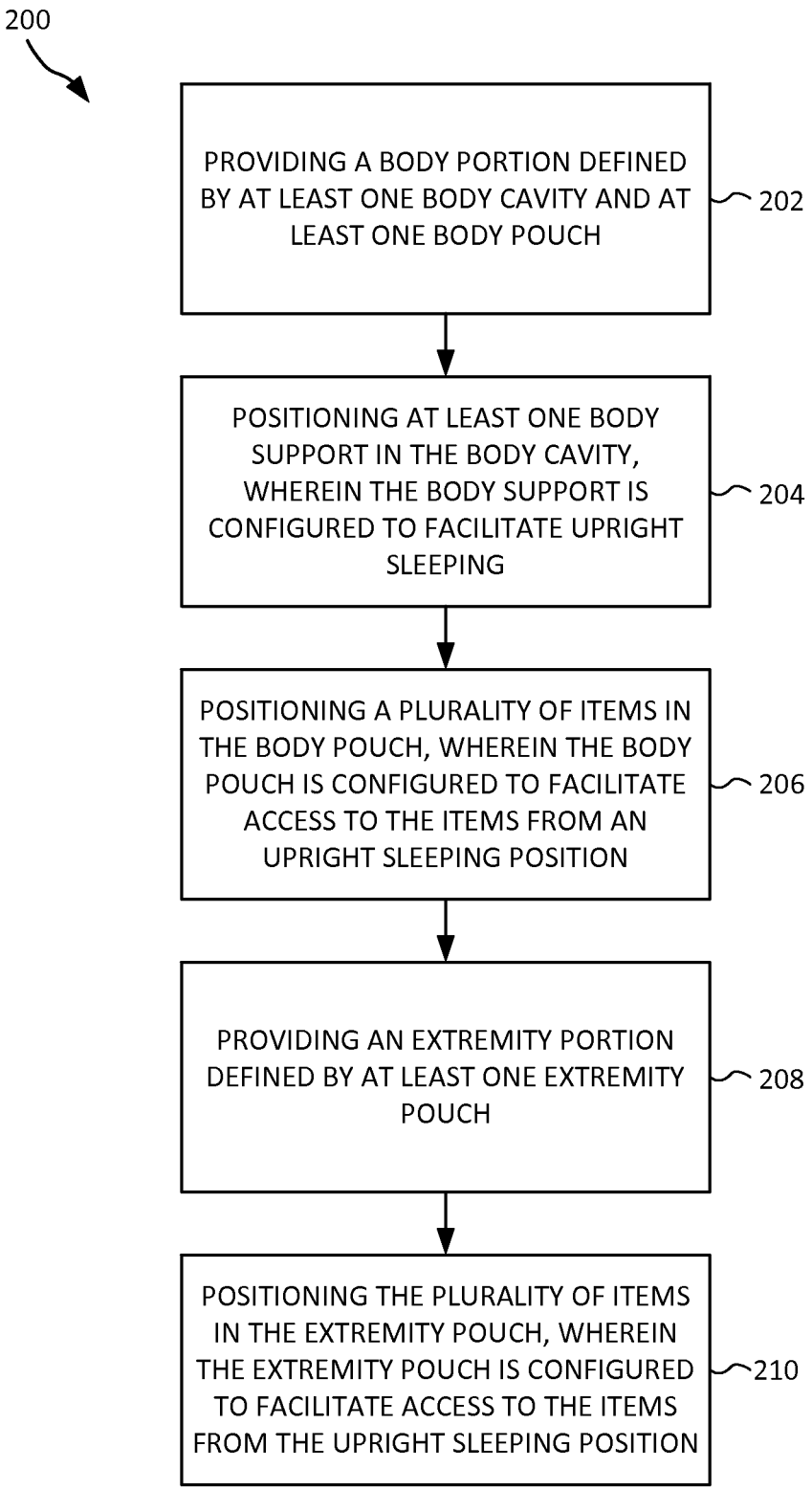
FIGS. 5A and 5B are flowchart diagrams of a method of facilitating upright sleep and access to a plurality of items while donning a multi-purpose travel garment.
Figure 5B:
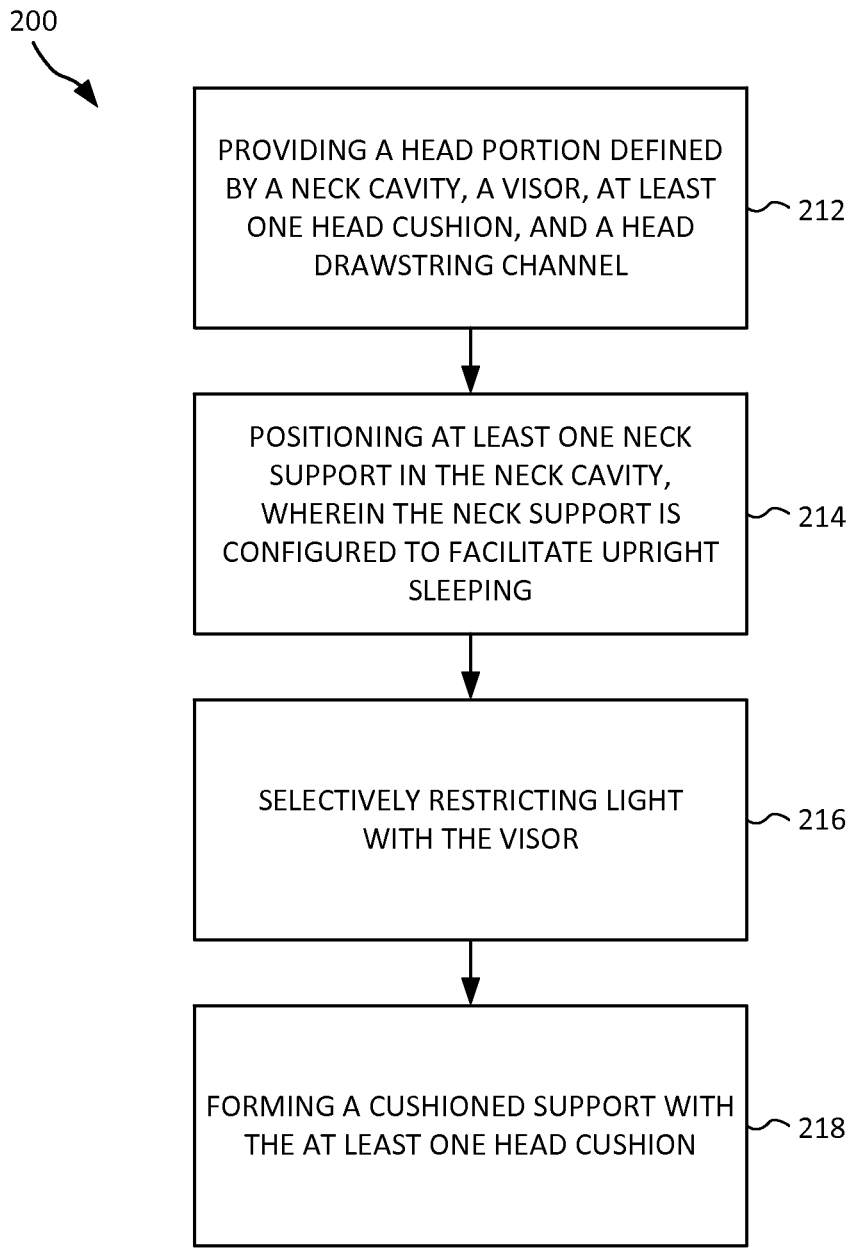

FIGS. 5A and 5B illustrates a flowchart diagram of an exemplary method 200 for facilitating upright sleep and access to sleep and travel related items while donning a multi-purpose travel garment 100. The garment 100 facilitates upright sleep and access to travel and sleep related items during travel by providing cavities 112, 124 that retain neck and torso supports for optimal support during sleep in an upright position, providing a body pouch 116 that is easily accessible to retain the sleep and travel related items, providing a head portion 122 that cushions and supports the head, while also selectively covering the eyes to block light during sleep, and forming a poncho configuration and a material composition that is warm and spacey for ease of movement.

The method may include an initial Step 202 of providing a body portion 102 defined by at least one body cavity 112 and at least one body pouch 116. The body portion 102 forms a substantial section of the garment 100 and provides the greatest storage capacity.

The body portion 102 is defined by a front side 108 and a back side 134. The front side 108 is generally oriented in a forward direction, covering the chest and pelvic area. The back side 134, as shown in FIG. 2, is generally oriented in a rearward direction, covering the back and buttocks. The body portion 102 comprises an upper end 104 that encompasses the shoulder and chest area. The body portion 102 may further include a lower end 106 that encompasses the lower torso and waist.

The method 200 may further comprise a Step 204 of positioning at least one body support in the body cavity 112, wherein the body support is configured to facilitate upright sleeping. The body cavity 112 is sized and dimensioned to retain at least one body support. The body support may include, without limitation, a sky rest pillow, an inflatable pillow, a fabric pillow, and a cushion. The body support helps provide a supportive, yet flexible cushion for the torso, back, and stomach areas.

A Step 206 includes positioning a plurality of items in the body pouch 116, wherein the body pouch 116 is configured to facilitate access to the items from an upright sleeping position. The body portion 102 may further include at least one body pouch 116 configured to store a plurality of items (not shown). The plurality of items may be useful for facilitating sleep and travel. The items may be stored in the body pouch 116 in an organized manner, such that the traveler can easily access each item while inclined during sleep or while in a casual position.

In some embodiments, a Step 208 comprises providing an extremity portion 118 defined by at least one extremity pouch 120. The extremity portion 118 includes a pair of terminal ends, such as cuffs that terminate at a hem 110. The hem may have an aesthetic appearance.

A Step 210 includes positioning the plurality of items in the extremity pouch 120, wherein the extremity pouch 120 is configured to facilitate access to the items from the upright sleeping position. Similar to the body portion 102, the extremity portion 118 includes at least one extremity pouch 120 configured to store the plurality of travel or sleep related items on the pair of garment 100 arms. The at least one extremity pouch 120 can position anywhere along the extremity portion 118, such as along the forearm section of the garment arm.

In some embodiments, a Step 212 may include providing a head portion 122 defined by a neck cavity 124, a visor 126, at least one head cushion 128, and a head drawstring channel 136. The head portion 122 may include a hoodie or cap that pivotally attaches to a perimeter of the upper end 104 of the body portion 102. In some embodiments, the head portion 122 may, however, detachably join with the body portion 102. In one embodiment, the head portion 122 encapsulates the head and ears. The head portion 122 also includes components to at least partially cover the eyes. In this manner, the head is protected from hard surface, noises, and lighting; and thereby sleep is enhanced.

A Step 214 comprises positioning at least one neck support in the neck cavity 124, wherein the neck support is configured to facilitate upright sleeping. The head portion 122 is defined by a neck cavity 124. The neck cavity 124 is disposed proximally to the junction between the head portion 122 and the upper end 104 of the body portion 102. The neck cavity 124 is configured to retain at least one neck support (not shown) that facilitates sleeping in the upright position. Similar to the body support, the neck support may be easily accessed from the neck cavity 124 for removal, insertion, realignment, and cleaning of the neck support.

A Step 216 includes selectively restricting light with the visor 126. The head portion 122 is further defined by a visor 126 that is configured to at least partially block light from the eyes. The visor 126 is configured to join with an opening in the head portion 122. The visor 126 is generally sized and dimensioned to cover the eyes. In this manner, light is restricted during sleep.

A final Step 218 includes forming a cushioned support with the at least one head cushion 128. The head portion 122 may include an outer or inner surface having at least one head cushion 128. The head cushion 128 provides additional comfort when the head engages a hard surface. The at least one head cushion 128 is disposed to contour an outer surface of the head portion 122; and thereby form a cushioned support for the head. In one embodiment, the at least one head cushion 128 comprises a pair of 2½" pads that run along the length of the head portion 122. The head portion 122 serves to provide warmth and at least partially cover the ears, thereby restricting undesirable sound.

Thus, the multi-purpose garment 100 facilitates sleep during travel by providing sufficient storage capacity for organizing and retaining sleep related items, including neck, head, and torso supports. Furthermore, the garment 100 creates a more conducive sleeping environment for a traveler by minimizing many of the obstacles encountered while attempting to sleep during travel.

Although the foregoing description and the drawings describe and illustrate many structural details and features, these should not be construed as limiting the scope of the appended claims but as merely providing illustrations of some of the illustrative embodiments of the disclosure. For example and without limitation, the body portion 102 of the multi-purpose travel garment 100 can be made in a broad range of sizes to match various body sizes and sleeping positions. The cavities and pouches can be disposed anywhere and in any orientation on the body portion 102, extremity portion 118, and head portion 122 of the travel garment 100. The material composition of the travel garment 100 may also be made out of any material which will meet the functional requirements of the application such as cotton, wool, nylon, polyester, spandex, rubber, non-woven materials, etc.

For the purposes of describing and defining the present disclosure it is noted that the use of relative terms such as "substantially", "generally", "approximately", and the like may be utilized herein to represent an inherent degree of uncertainty that may be attributed to any quantitative comparison, value, measurement or other representation. These terms may also be utilized herein to represent the degree by which a quantitative representation may vary from a stated reference without resulting in a change in the basic function of the subject matter at issue.

Exemplary embodiments of the present disclosure are described herein above. No element, act, or instruction used in this description should be construed as important, necessary, critical, or essential to practice the various embodiments unless explicitly described as such. Although only a few of the exemplary embodiments have been described in detail herein, those skilled in the art will readily appreciate that many modifications are possible in these exemplary embodiments without materially departing from the novel teachings and advantages of this disclosure. Accordingly, all such modifications are intended to be included within the scope of this disclosure as described herein.

While exemplary embodiments of the disclosure have been described above, it will be recognized and understood that various modifications can be made and the appended claims are intended to cover all such modifications which may fall within the spirit and scope of the disclosure.

What is claimed is:

1. A travel garment, comprising:

a body portion, the body portion configured to at least partially cover a torso and a back, the body portion defined by at least one body cavity and at least one body pouch, the at least one body cavity configured to contain at least one body support, the at least one body support configured to enable at least partial support of the torso and the back, the at least one body pouch configured to contain a plurality of items;

an extremity portion, the extremity portion configured to at least partially cover a pair of arms, the extremity portion defined by at least one extremity pouch, the at least one extremity pouch configured to contain the plurality of items; and a head portion, the head portion configured to at least partially cover a head and a neck, the head portion defined by a neck cavity, a visor, and at least one head cushion, the neck cavity configured to contain at least one neck support, the at least one neck support configured to enable at least partial support of the head and the neck, the visor configured to selectively restrict light to the eyes, the at least one head cushion configured to enable a dampening support for the head, wherein the at least one head cushion being disposed to contour an outer surface of the head portion, whereby the neck cavity, and thereby the at least one neck support, are oriented in any direction relative to the at least one head cushion.

2. The garment of claim 1 wherein the travel garment is a poncho or sweatshirt.

3. The garment of claim 1 wherein the body portion comprises an upper end, a lower end, a front side, and a back side.

4. The garment of claim 3 wherein the upper end and the lower end of the body portion comprise at least one pleat.

5. The garment of claim 4 wherein the lower end of the body portion comprises a body adjustment mechanism, the body adjustment mechanism configured to selectively tighten and loosen the body portion around the torso.

6. The garment of claim 5 wherein the body adjustment mechanism comprises a drawstring and a drawstring lock.

7. The garment of claim 1 wherein the at least one body cavity comprises a body cavity fastener, the body cavity fastener configured to regulate access to the at least one body cavity.

8. The garment of claim 1 wherein the at least one body pouch comprises a channel, the channel configured to enable passage of circuitry of an operatively connected electrical device.

9. The garment of claim 1 wherein the head portion comprises a head adjustment mechanism, the head adjustment mechanism configured to selectively tighten and loosen the head portion around the head and the neck.

10. The garment of claim 9 wherein the head adjustment mechanism comprises a head drawstring and a head drawstring lock.

11. The garment of claim 10 wherein the head portion comprises a head drawstring channel, the head drawstring channel configured to enable passage of the head drawstring around a perimeter of the head portion.

12. The garment of claim 1 wherein the at least one head cushion comprises a pair of 2½" pads that extend along the length of the head portion.

13. The garment of claim 1 wherein the plurality of items are generally sleep and travel related.

14. The garment of claim 1 wherein the plurality of items includes at least one member selected from the group consisting of: a travel document, an identification card, a communication device, a radio, MP3 player, a microprocessor, a key, toiletries, food, drinks, batteries, and therapeutic and medicinal drugs.

15. The garment of claim 1 further including a pump, the pump configured to generate a fluid for filling the at least one body support and the at least one neck support.

16. The garment of claim 1 further including a container, the container defined by a rigid base and resilient sidewalls, the container further defined by a strap, the strap configured to enable carrying and compacting of the container, the container configured to compact for stowage in the at least one body pouch, the container further configured to expand for functionality.

17. A method of facilitating upright sleep and access to a plurality of items while donning a multi-purpose travel garment, the method comprising:

providing a body portion defined by at least one body cavity and at least one body pouch;

positioning at least one body support in the body cavity, wherein the body support is configured to facilitate upright sleeping;

positioning a plurality of items in the body pouch, wherein the body pouch is configured to facilitate access to the items from an upright sleeping position;

providing an extremity portion defined by at least one extremity pouch;

positioning the plurality of items in the extremity pouch, wherein the extremity pouch is configured to facilitate access to the items from the upright sleeping position;

providing a head portion defined by a neck cavity, a visor, at least one head cushion, and a head drawstring channel;

positioning at least one neck support in the neck cavity, wherein the neck support is configured to facilitate upright sleeping;

selectively restricting light with the visor; and forming a cushioned support with the at least one head cushion, wherein the at least one head cushion being disposed to contour an outer surface of the head portion, whereby the neck cavity, and thereby the at least one neck support, are oriented in any direction relative to the at least one head cushion.

18. The method of claim 17 further including adjusting the size of a lower end of the body portion with a body adjustment mechanism and adjusting the size of the head portion with a head adjustment mechanism.

19. The method of claim 17 further including accessing the at least one body support through a body cavity fastener.

20. A travel garment, comprising:

a body portion, the body portion configured to at least partially cover a torso and a back, the body portion defined by at least one body cavity and at least one body pouch, the at least one body cavity configured to contain at least one body support, the at least one body support configured to enable at least partial support of the torso and the back, the at least one body cavity comprising a body cavity fastener, the body cavity fastener configured to regulate access to the at least one body cavity, the at least one body pouch configured to contain a plurality of items, wherein the plurality of items are generally sleep and travel related;

an extremity portion, the extremity portion configured to at least partially cover a pair of arms, the extremity portion defined by at least one extremity pouch, the at least one extremity pouch configured to contain the plurality of items;

a head portion, the head portion configured to at least partially cover a head and a neck, the head portion defined by a neck cavity, a visor, at least one head cushion, a head adjustment mechanism, and a head drawstring channel, the neck cavity configured to contain at least one neck support, the at least one neck support configured to enable at least partial support of the head and the neck, the visor configured to selectively restrict light to the eyes, the at least one head cushion configured to enable a dampening support for the head, wherein the at least one head cushion being disposed to contour an outer surface of the head portion, whereby the neck cavity, and thereby the at least one neck support, are oriented in any direction relative to the at least one head cushion;

a pump, the pump configured to generate a fluid for filling the at least one body support and the at least one neck support; and a container, the container defined by a rigid base and resilient sidewalls, the container further defined by a strap, the strap configured to enable carrying and compacting of the container, the container configured to compact for stowage in the at least one body pouch, the container further configured to expand for functionality.

* * * * *